US009291331B2

(12) United States Patent
Keng

(10) Patent No.: US 9,291,331 B2
(45) Date of Patent: Mar. 22, 2016

(54) SNAP-ON LENS FOR LED LIGHT FIXTURE

(71) Applicant: CORDELIA LIGHTING, INC., Rancho Dominguez, CA (US)

(72) Inventor: James Keng, Rancho Dominguez, CA (US)

(73) Assignee: CORDELIA LIGHTING, INC., Rancho Dominguez, CA (US)

( * ) Notice: Subject to any disclaimer, the term of this patent is extended or adjusted under 35 U.S.C. 154(b) by 252 days.

(21) Appl. No.: 14/213,519

(22) Filed: Mar. 14, 2014

(65) Prior Publication Data

US 2014/0268803 A1 Sep. 18, 2014

Related U.S. Application Data

(60) Provisional application No. 61/799,042, filed on Mar. 15, 2013.

(51) Int. Cl.

| | |
|---|---|
| ***F21V 5/04*** | (2006.01) |
| ***F21S 8/06*** | (2006.01) |
| ***F21V 17/12*** | (2006.01) |
| ***F21V 17/16*** | (2006.01) |
| ***F21S 8/04*** | (2006.01) |

(52) U.S. Cl.
CPC . *F21V 5/04* (2013.01); *F21S 8/046* (2013.01); *F21S 8/063* (2013.01); *F21V 17/12* (2013.01); *F21V 17/164* (2013.01)

(58) Field of Classification Search
CPC ..... F21V 5/04; F21V 3/02; F21V 17/12; F21V 17/104; F21V 17/10; F21V 17/04; F21V 19/0035; F21S 8/046; F21K 9/10
USPC ..... 362/264, 265, 363, 443
See application file for complete search history.

(56) References Cited

U.S. PATENT DOCUMENTS

| | | | | |
|---|---|---|---|---|
| 4,723,200 | A * | 2/1988 | Troen | 362/260 |
| 8,421,321 | B2 * | 4/2013 | Chuang | 313/46 |
| 2006/0232974 | A1 * | 10/2006 | Lee et al. | 362/294 |
| 2007/0058374 | A1 | 3/2007 | Dupre | |
| 2012/0182744 | A1 | 7/2012 | Santiago et al. | |
| 2013/0010476 | A1 | 1/2013 | Pickard et al. | |
| 2013/0027938 | A1 * | 1/2013 | Hisayasu | 362/249.02 |
| 2013/0128576 | A1 * | 5/2013 | Seki et al. | 362/235 |
| 2013/0301268 | A1 * | 11/2013 | Johnston et al. | 362/249.02 |
| 2014/0218931 | A1 * | 8/2014 | Desilva et al. | 362/294 |

OTHER PUBLICATIONS

"Assembly & Installation Instructions" for incandescent bath and vanity light fixture, Cordelia Lighting Inc., 1 page, 2004.

* cited by examiner

*Primary Examiner* — Evan Dzierzynski
*Assistant Examiner* — Leah S Macchiarolo
(74) *Attorney, Agent, or Firm* — Paul Y. Feng; One LLP

(57) ABSTRACT

A solid state lamp having a threaded base with an LED light source receives a threaded ring with a snap-on lens. The snap-on lens has cantilevered fingers with pegs on the distal ends that snap into receiving holes in the ring. The ring has internal threads that screw on to the base. A lamp shade is held on to the base when the ring is screwed on to the base. The lamp is adapted to work with light fixtures or a ceiling fan.

11 Claims, 5 Drawing Sheets

52
34
DRIVER
36
32
30

32
38
40
42
12
10
48
36
THREADED SOCKET RING
LENS
36
34
30
36

SNAP-ON LENS FOR LED LIGHT FIXTURE

CROSS-REFERENCE TO RELATED APPLICATIONS

This application claims priority to U.S. provisional patent application No. 61/799,042, filed Mar. 15, 2013, the entire contents of which are hereby incorporated by reference.

FIELD OF THE INVENTION

The present invention relates to solid state lighting fixtures. In particular, the present invention relates to a snap-on lens and ring assembly in combination with a solid state lamp fitted to a light fixture or a ceiling fan.

BACKGROUND OF THE INVENTION

Solid state light fixtures lead to saving energy and improving the service life of the light source over incandescent bulbs and fluorescent tubes, for instance. Many light fixtures in residential and commercial application use obsolete incandescent bulbs and need to be replaced by energy efficient light fixtures.

Early 20$^{th}$ century incandescent light fixtures found in a bathroom, for example, featured a back plate mounted to the wall, and a lamp extending from the back plate. The lamp had an Edison light socket to receive a 60 watt or 75 watt bulb. The bulb was typically emplaced within a decorative glass or plastic lamp shade. The lamp shade had a groove at its base which was held in place by radial screws that were advanced into the groove to hold the shade to the lamp. More current lamps have the same incandescent bulb attached to an Edison socket, wherein the shade is threaded on to the socket exterior with use of a collar.

SUMMARY OF THE INVENTION

The present invention in various preferred embodiments is directed to a solid state lamp, comprising a base having a proximal end and a distal end, and external threads; a solid state light source disposed on the distal end of the base; a lens having a plurality of resilient, cantilevered fingers extending from the lip of the lens; a ring having a matching dimension to engage the lip of the lens, and having openings for receiving the plurality of fingers for the lens to snap on to the ring; threads formed within the ring adapted to engage the base threads; and a shade fitted over the base, lens and ring.

The lens is preferably made from a translucent, resilient polymeric material and has a flattened dome shape. The base has a cylindrical shape to facilitate screw threading action during assembly. The resilient fingers snap into complementary openings in the ring, and the ring threads onto the base. The decorative lamp shade is held by the ring against the base when the ring is screwed onto the base. The solid state lamp can be joined to the light switch housing of a ceiling fan, or to any light fixture that uses a screw-on light shade or reflector cup.

DETAILED DESCRIPTION OF THE PREFERRED EMBODIMENTS

Figure 1B:
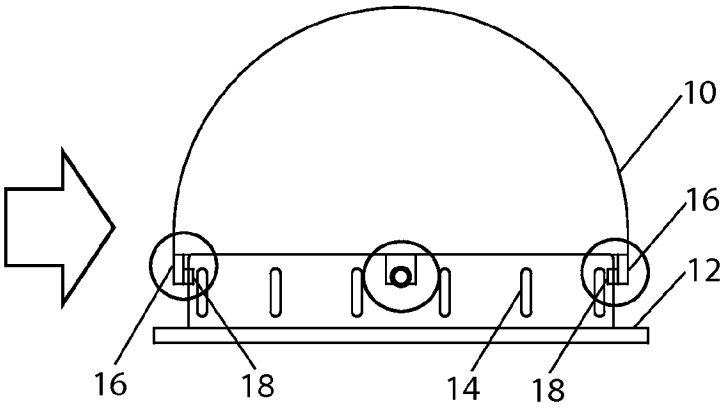
FIG. 1*b* is the lens assembled to the ring.
Figure 1A:
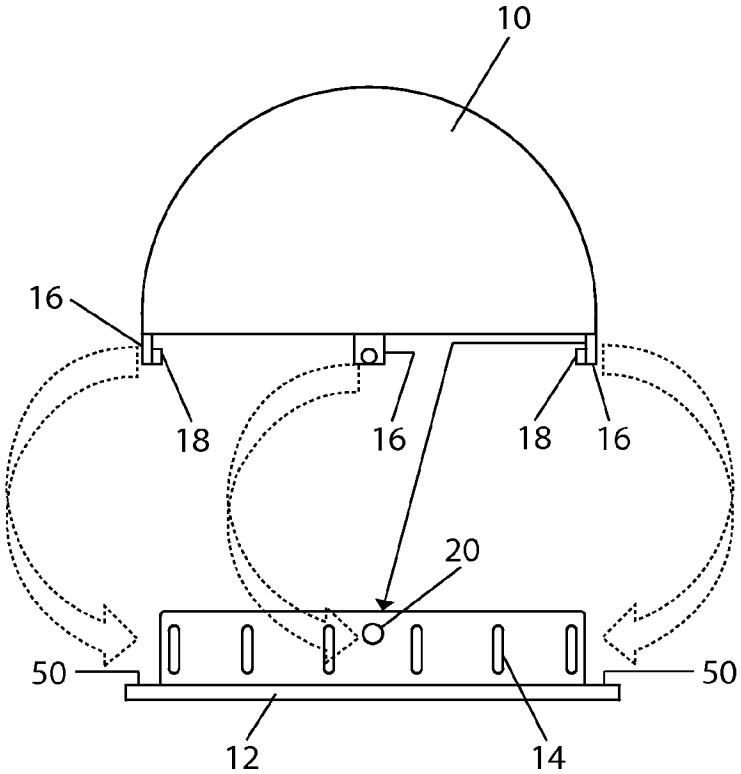
FIG. 1*a* is an exploded view of a preferred embodiment snap-on lens and ring.

The present invention in various preferred embodiments is directed to a snap-on lens, diffuser, reflector or cover and ring assembly for use in a LED light fixture typically installed in residential homes and commercial buildings. As seen in FIGS. 1*a* and 1*b*, showing a preferred embodiment, the lens 10 has a hemispherical or dome shape and it attaches to a ring 12. The ring 12 may be part of a LED light fixture, typically attached to the trim or formed as part of the trim. The ring 12 as depicted in the drawing figure has a series of optional ports or slots 14 around its periphery, which can be used for cooling or attachment of other hardware. The ring 12 when attached to the trim or is formed as part of the trim provides an attachment point for the lens 10.

The domed lens 10 includes preferably three cantilevered fingers 16 with locator pegs 18 at the distal end of each. The peg 18 takes the form of a button or a bump, or may alternatively be shaped like a triangular wedge and function more like a hook. When the lens 10 is assembled to the ring 12 as shown in FIG. 1*b*, the cantilevered fingers 16 position the pegs 18 over the respective receiving openings, pits, or holes 20 formed in the ring 12 so that the pegs 18 snap-fit into those holes 20.

The lens 10 is preferably made from a polymer, so the material has sufficient resilience such that the cantilevered fingers can flex slightly to snap the locator pegs or hooks into their respective holes 20 in the ring 12. If the lens is made from glass, there is less resilience in the cantilevered fingers, but the ring can be made from a thin sheet of metal or plastic which does have sufficient flex to provide the snap-in fit for the pegs into their respective holes. The holes 20 may be through holes or a blind hole having a bottom. Or the surface of the ring may have a simple contour that the hook at the end of the finger can latch on to.

Once assembled, there is a tight fit between the lens 10 and the ring 12 so there is essentially no gap between the interfacing surfaces, which preferably have matching diameters or dimensions. Because of the few parts involved, the manufacturing tolerances of the two interfacing surfaces can be close to ensure an even or flush fit between the lens 10 and the ring 12. It is therefore less likely that there will be a gap at the interface so errant light might leak through.

Moreover, with the present invention snap-fit attachment, the lens 10 sits low against the ring 12, which ring 12 if attached or formed as part of the trim in a LED light fixture, contains a light generating LED cluster or array. Because the lens 10 sits low against the ring, the light dispersion is fairly uniform so the entire lens is preferably lit up evenly without dark bands, spots, or shadows. This produces a very pleasing appearance for the lens when lit up and observed by the consumer.

There can be, in alternative embodiments, more or fewer than three fingers as shown, and other shapes and sizes for the hooks/pegs are contemplated. In the preferred embodiment, the lens is formed with the cantilevered fingers and pegs, but the latter can be glued, spot welded, or mechanically attached to the lens. The lens may have other shapes including a cylinder, a square or rectangular prism, flattened dome, oval, and the like. Because of few mounting parts required for the lens, and the lens sitting low against the ring, an LED light fixture using the present invention lens has a low profile appearance. The lens may be frosted, translucent, transparent, textured, and include various colors and surface and glass treatments for decorative and light dispersion purposes. The lens further protects the LED chips from dust collection, accidental finger touch, or water splashes.

In another alternative embodiment, the fingers of the lens may hook into a complementary L-shaped opening in the ring so attachment method is by pushing and rotating the fingers of the lens along the "L." Other attachment means are contemplated, such as having the lens include a lip that screws on to threads on the ring. The lens may have external threads and the ring has the complementary internal threads, or vice versa. The ring may have screw fasteners that can be advanced radially inward to engage a circumferential groove in the lens to hold the two parts together.

Figure 2A:
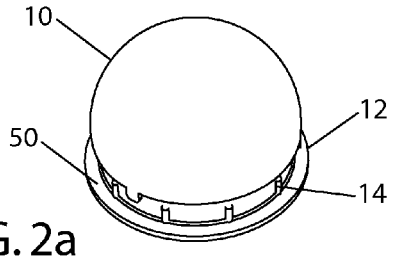
FIGS. 2*a*-2*f* depict various views of the snap-on lens and ring assembly from FIG. 1.
Figure 2D:
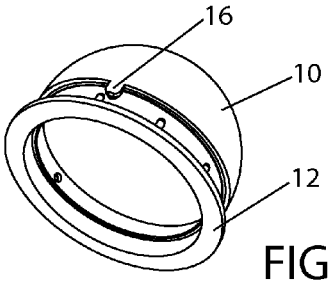
Figure 2B:
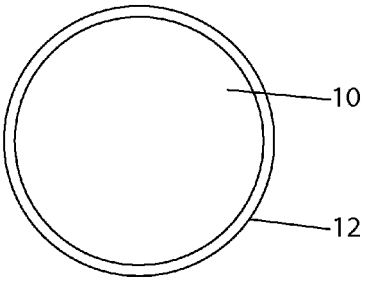
Figure 2E:
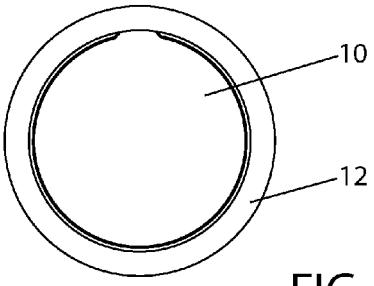
Figure 2C:
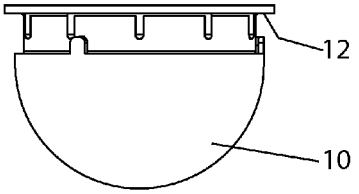
Figure 2F:
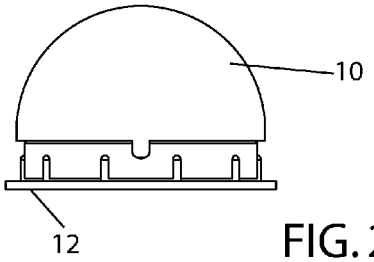
Figure 2G:
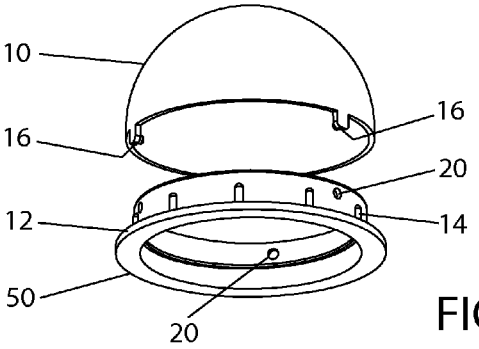
FIG. 2*g* is a perspective view of the lens detached from the ring.

FIGS. 2*a*-2*f* contain various views of the lens-ring assembly from FIGS. 1*a* and 1*b*. FIG. 2*g* provides a perspective view of the lens 10 disassembled from the ring 12. Because the connection between the lens 10 and ring 12 is a snap-fit, the homeowner or maintenance crew can easily swap lenses as desired. Changing lenses alters the light emitted by the fixture as to the light distribution pattern, light intensity, color, etc.

Figures 3A, 3B:
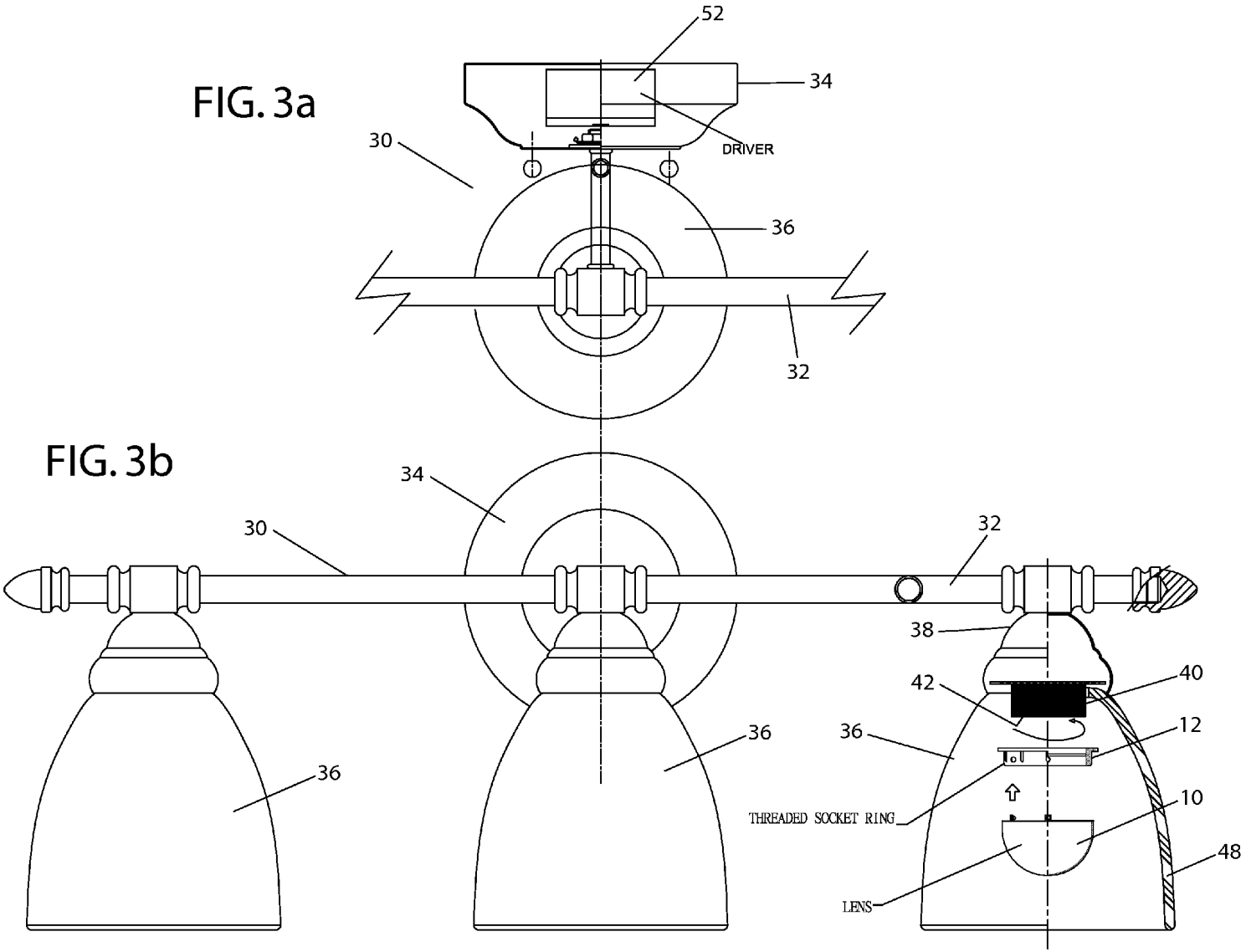
FIG. 3*a* is a top plan view of one application of the snap-on lens and ring assembly employed in a three-lamp LED bathroom bar fixture.
FIG. 3*b* is a front elevational view of the bath bar with one of the lamps shown in partial cross-section.
Figure 4:
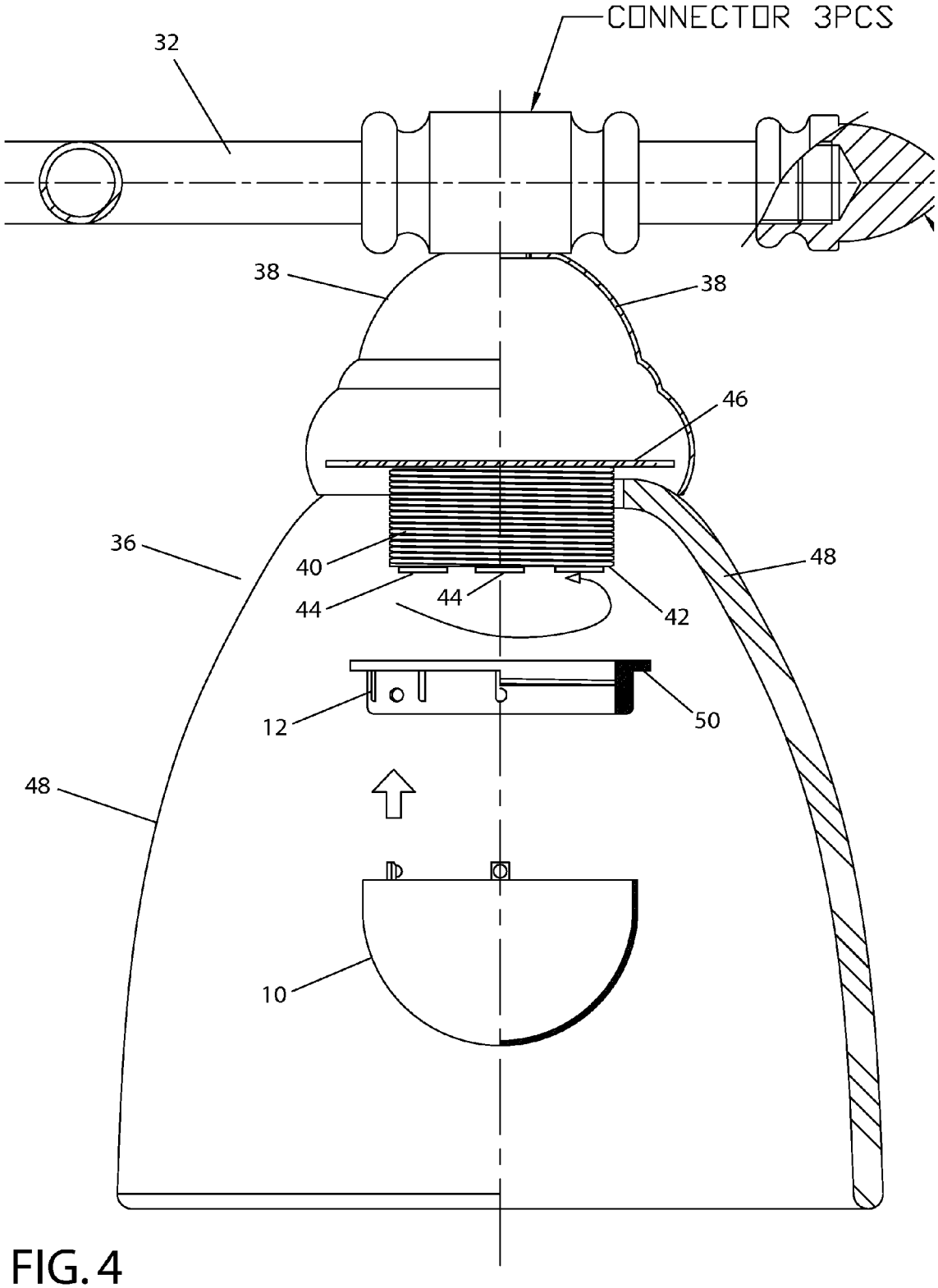
FIG. 4 is an isolated view of one lamp from FIG. 3 shown in partial cross-section.

FIGS. 3*a* and 3*b* show one application of the snap-on lens and ring assembly in combination with an LED base. FIG. 3*b* is a front elevational view of a solid state bath bar light fixture 30. The light fixture 30 has a decorative cross-bar 32 with a back plate 34, attached to a wall or ceiling. The cross-bar 32 in this exemplary embodiment has three lamps 36. FIG. 4 is an isolated view, partially in cross-section, of one lamp 36. The lamp 36 has a glass holder cup 38 at the top affixed to the cross-bar 32. Inside the glass holder cup 38 is a cylindrical-shaped base 40 having a threaded exterior. The distal end 42 of the base 40 is preferably flat and includes a solid state light source such as an LED array 44, while the proximal end 46 is mounted to the interior of the glass holder cup 38. In an alternative embodiment, the distal end 42 may have facets, a bump, or contours if desired to aim the LED chips 44 mounted thereon in different directions. The base 40 is preferably made from a metallic material and has a cylindrical shape to accommodate external screw threads for assembly. The base 40 further has sufficient mass and the material, preferably steel, aluminum, zinc, or the like, is selected to act as a heat sink to dissipate heat generated by the LED array 44. The base 40 preferably has an internal conduit or hollow interior to hold electrical wiring.

A shade 48 in the form of a cup made of glass or plastic serves as a decorative finish for the lamp 36. The shade 48 may be transparent, translucent, or opaque with or without a reflective coating on its interior. As seen in FIG. 4, the shade 48 has a center opening allowing the base 40 to freely pass through it, and the ring 12, which has internal threads, is advanced over the threads of the base 40. An optional flange 50 in the ring 12 engages the shade 48 to hold the shade in place when the ring 12 is screwed on to the base 40. The lens 10 snaps on to the ring 12 as previously described With the components assembled, the lens 10 protects the LED array 44 from accidental finger touch, dust accumulation, water splashes, short circuits by accidental contact with metal, etc., and further controls light dispersion, light intensity, color, etc. These elements can be adjusted by selection of the material for the lens, shape of the lens, surface contours of the lens, and thickness of the lens. The shade 48 enhances the appearance of the lamp 36, and can be easily changed out by unscrewing the ring 12 from the base 40. Beneficially, the lens 10 does not need to be detached from the ring 12 for this purpose.

Electrical wiring (not shown) extends from the LED array 44 up through the base 40, then up into the glass holder cup 38 and through the cross-bar 32, and into the back plate 34. As seen in the top plan view of FIG. 3*a*, the back plate 34 preferably contains the LED driver 52. The back plate 34 is mounted to a wall or the ceiling and the LED driver 52 is electrically wired to the house or building. In this preferred embodiment, one LED driver 52 powers all three lamps 26. Of course, it is contemplated that there can be more or fewer lamps than that shown in the drawings, and the arrangement or orientation of the lamps can be changed and not necessarily disposed on a cross-bar.

Figure 5B:
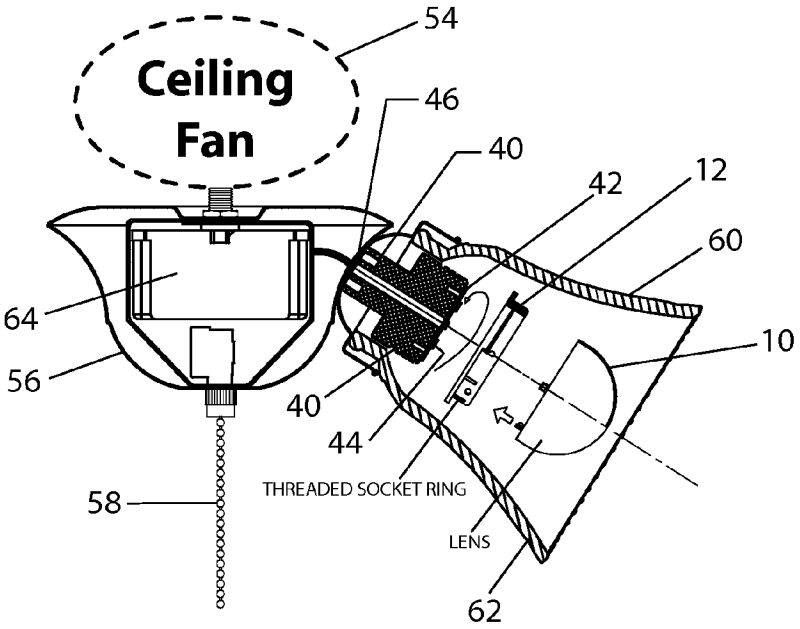
FIG. 5*b* is a side elevational view partially in cross-section showing the snap-on lens and ring assembly.
Figure 5A:
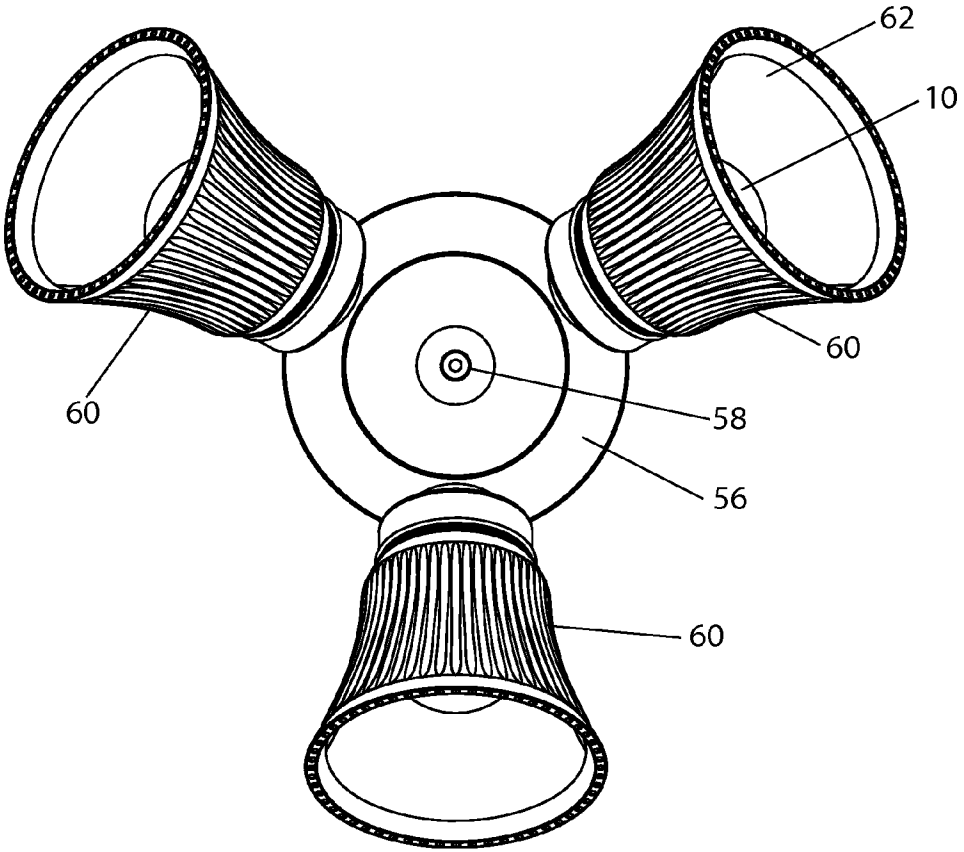
FIG. 5*a* is bottom view of the preferred embodiment snap-on lens and ring assembly employed in another application as attached to the switch housing of a ceiling fan.

FIGS. 5*a* and 5*b* show another application of the snap-on lens and ring assembly, which in this embodiment is attached to a standard ceiling fan 54 found in homes, restaurants, hotels, and commercial establishments. At the base of the fan 54 below the fan blades is the light switch housing or switch housing 56, typically containing the on/off switch for the light source and/or fan motor, fan blade direction, and speed controls for the fan motor. FIG. 5*b* is a side elevational view, partially in cross-section, showing a typical pull chain 58 for activating the light source's and/or fan's on/off switch extending from the bottom of the switch housing 56.

FIG. 5*a* is a bottom view of the switch housing 56 and three lamps 60 for the ceiling fan (not shown). FIG. 5*b* shows the details of one lamp 60, which has a base 40 having external threads, attached to the switch housing 56 at the proximal end 46 and bearing an LED array 44 at the distal end 42. In the preferred embodiment, the ring 12 has internal threads that can be advanced over the external threads of the base 40, while the ring 12 is joined to the lens 10 by snap fit via attachment means described earlier. A preferably cup shaped shade 62 with a center opening fits over the base 40. Advancing the ring 12 onto the base 40 presses the ring 12 against the shade 62 to hold it in place. As explained above, changing out the shade 62 for a different style and appearance is easily accomplished by unscrewing the ring 12 and pulling the unwanted shade 62 off of the base 40 and then switching shades.

The LED array 44 is wired to the LED driver 64 inside the switch housing 56 via a conduit in the base 40. As such, the lamps 60 and fan 54 can be controlled by the pull chain 58, or by other control devices known in the art. The LED driver 64 is then wired to the fan motor and electrical house lines as usual.

As seen in the two exemplary embodiments above, the snap-on lens and ring assembly in combination with the LED array mounted on a threaded base can be incorporated into a cross-bar light fixture or a ceiling fan. Those skilled in the art can adapt the present invention combination to a chandelier light fixture, mini pendant light fixture, track light fixture, spot light fixture, wall or ceiling light fixture, portable light fixtures such as desk lamps, floor lamps, task lamps, table lamps, tree lamps, torchère or torchier lamps, etc., or wherever the light fixture uses a glass shade, a reflector cup, or the like with a threaded base.

While particular embodiments of the invention have been illustrated and described, it will be apparent that various modifications can be made without departing from the spirit and scope of the invention. It is contemplated that components from one embodiment may be combined with components from another embodiment.

What is claimed is:

1. A solid state lamp, comprising:

a hollow base having a proximal end and a distal end, and external threads;

an LED array disposed on the distal end of the base with electrical wiring passing through the base;

a lens having a plurality of cantilevered fingers extending from the lip of the lens;

a ring having a substantially matching diameter to engage the lip of the lens, and having openings for receiving the plurality of fingers for the lens to snap on to the ring;

internal threads formed within the ring adapted to engage the base threads; and a cup-shaped shade fitted over the base, lens and ring.

2. The solid state light fixture of claim 1, wherein the lens includes at least one of a glass and plastic material.

3. The solid state light fixture of claim 1, wherein the base includes a heat dissipating metallic material.

4. The solid state light fixture of claim 1, wherein the lens includes a dome shape to evenly disperse light from the LED array.

5. The solid state light fixture of claim 1, wherein the ring includes cooling ports.

6. The solid state light fixture of claim 1, wherein the ring includes a material selected from the group of materials consisting of ceramic, metal, or plastic.

7. A solid state lamp, comprising:

a cylindrical base having a proximal end and a distal end, and external threads, where electrical power is supplied to the proximal end;

an LED array disposed on the distal end of the base;

a lens having an attachment means;

a ring having a substantially matching dimension to the lens, and having a receiving means that engage the attachment means to join the lens to the ring;

threads formed within the ring adapted to engage the base threads; and a shade fitted over the base, lens and ring.

8. The solid state lamp, of claim 7, wherein the base includes a metallic material and has sufficient mass to function as a heat sink.

9. The solid state lamp, of claim 7, wherein the lamp is assembled to ceiling fan.

10. The solid state lamp, of claim 7, wherein the lamp is assembled to a light fixture including a chandelier light fixture, a mini pendant light fixture, a track light fixture, a spot light fixture, a wall light fixture, a ceiling light fixture, a portable light fixture, a desk lamp, a floor lamp, a task lamp, a table lamps, a tree lamp, a torchère lamps.

11. A solid state lamp, comprising:

a base having a proximal end and a distal end, and external threads;

a solid state light source disposed on the distal end of the base;

a lens having a plurality of resilient, cantilevered fingers extending from the lip of the lens;

a ring having a matching dimension to engage the lip of the lens, and having openings for receiving the plurality of fingers for the lens to snap on to the ring;

threads formed within the ring adapted to engage the base threads; and a cup-shaped shade fitted over the base, lens and ring.

* * * * *